US006048248A

United States Patent [19]

Ritchey

[11] Patent Number: 6,048,248

[45] **Date of Patent: *Apr. 11, 2000**

[54] APPARATUS FOR HOLDING A QUANTITY OF STUFFING MATERIAL AND METHOD OF ASSEMBLING SAME

[75] Inventor: Sharon A. Ritchey, Coral Springs, Fla.

[73] Assignee: Cats With An Attitude, Inc., Phoenix, Ariz.

[ * ] Notice: Under 35 U.S.C. 154(b), the term of this patent shall be extended for 170 days.

[21] Appl. No.: 08/612,385

[22] Filed: Mar. 7, 1996

[51] Int. Cl.[7] ..... A63H 33/00; A63H 3/02

[52] U.S. Cl. ..... 446/71; 446/369

[58] Field of Search ..... 446/71, 72, 369, 446/901, 73, 76, 80, 370, 371, 372, 385, 387

[56] References Cited

U.S. PATENT DOCUMENTS

| | | | |
|---|---|---|---|
| 2,591,379 | 4/1952 | Schradermeier | 446/72 |
| 4,563,159 | 1/1986 | Hills et al. | 446/369 X |
| 4,715,840 | 12/1987 | Swift | 446/369 X |
| 4,737,129 | 4/1988 | Gorley et al. | 446/72 |
| 4,950,194 | 8/1990 | Gullace | 446/72 |
| 4,954,114 | 9/1990 | Kawachima | 446/901 X |

OTHER PUBLICATIONS

Doll Pattern #6993, Butterick Pattern Service, Butterick Company, Inc., Copyrright 1988.

*Primary Examiner*—D Neal Muir
*Attorney, Agent, or Firm*—Meschkow & Gresham, P.L.C.; Jordan M. Meschkow; Lowell W. Gresham

[57] ABSTRACT

An apparatus for holding a quantity of stuffing material includes a pliable fabric shell having an opening that facilitates the insertion and removal of stuffing material. The opening is releasably sealed with sealing elements located on a plurality of flaps that surround the opening. The apparatus is constructed such that the flaps and the opening are of approximately the same length. The flaps extend within the shell and the sealing elements engage to seal the opening. When the shell is sealed, the flaps and the sealing elements are hidden from view and physically unexposed.

8 Claims, 2 Drawing Sheets

APPARATUS FOR HOLDING A QUANTITY OF STUFFING MATERIAL AND METHOD OF ASSEMBLING SAME

BACKGROUND OF THE INVENTION

1. Field of the Invention

The present invention relates generally to stuffed toys. In particular, the present invention relates to a stuffed toy having a sealable opening that facilitates the addition and removal of stuffing material.

2. The Prior Art

Stuffed toys and other common goods that utilize a filler material are designed for a variety of uses. For example, children play with stuffed animals, dolls, and balls of countless shapes and sizes, fragrance-filled bags are used to deodorize various environments, and fabric pouches or containers are designed to carry and apply cosmetic or other agents. In addition, cat toys (and other animal playthings) may utilize a fabric shell to carry an amount of catnip or other aromatic substance.

Many stuffed toys for animals are permanently sealed such that there is no access to the filler material. Although pet toys may be filled with a variety of materials, cats particularly enjoy playing with toys filled with catnip because of the minty fragrance of the catnip. Unfortunately, catnip toys that are permanently sealed may have to be replaced after the catnip loses its "freshness." Similarly, bags filled with potpourri or other fragrant material are usually disposed of when they lose their characteristic scents.

Some stuffed toys may provide access to the filler materials to extend the useful life of the toys. For example, some stuffed toys incorporate a zipper or other closure device to facilitate the insertion and removal of the filler materials. However, zippers, snaps, buttons, and other closure devices can be unsightly if they are visually exposed. Furthermore, a stuffed toy may be accidentally opened by a child or a pet if the closure device is physically exposed or easily manipulable.

Some prior art stuffed toys may utilize asymmetrical patterns and/or bulky closure devices. Such features can make assembly difficult by causing the pattern to pucker, kink, or deform during stitching or other manufacturing processes. In addition, such features can adversely affect the function and appearance of the finished product.

SUMMARY OF THE INVENTION

Accordingly, it is an advantage of the present invention that an improved fabric toy for holding a quantity of stuffing material is provided.

Another advantage of the present invention is that it provides a fabric toy having a sealable opening for the insertion and removal of filler material.

A further advantage is that the present invention provides a fabric toy that incorporates sealing elements that are visually and physically unexposed when the fabric toy is sealed.

Another advantage is that the fabric toy is relatively easy to assemble.

An additional advantage is that the present invention provides a fabric toy that experiences little puckering and kinking during assembly.

The above and other advantages of the present invention are carried out in one form by an apparatus for holding a quantity of stuffing material. The apparatus includes a pliable shell having an interior cavity, an opening formed within the shell, a plurality of flaps surrounding the opening, and means for releasably sealing the opening. The opening provides access to the interior cavity and the means for sealing is coupled to the flaps.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENT

Figure 1:
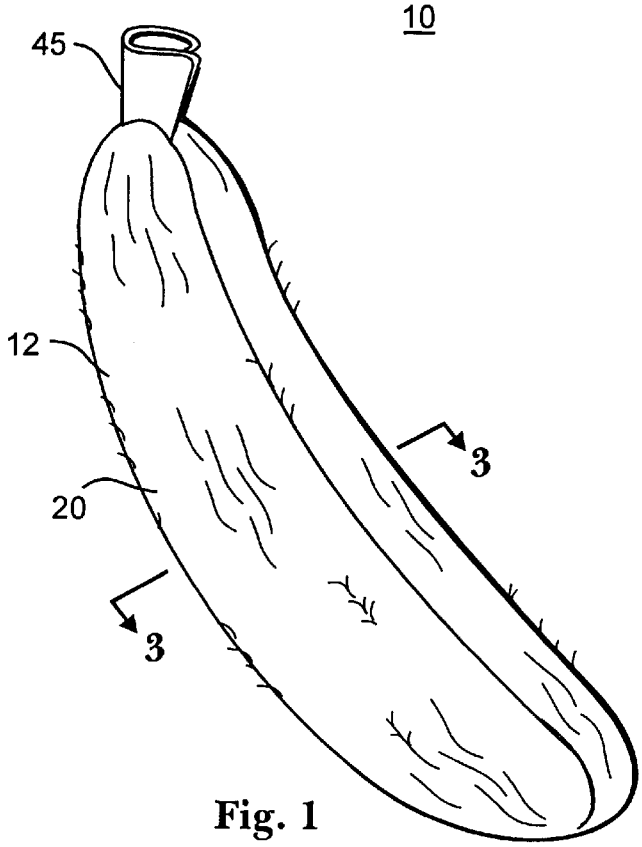
FIG. 1 is a perspective view of a fabric toy for holding a quantity of stuffing material with its opening sealed.
Figure 2:
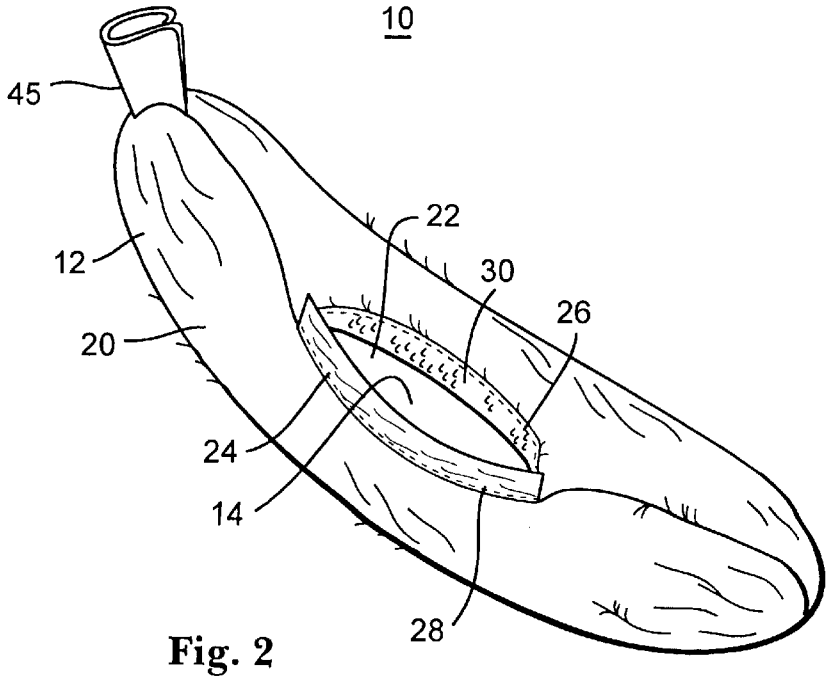
FIG. 2 is a perspective view of the fabric toy with its opening unsealed.
Figure 3:
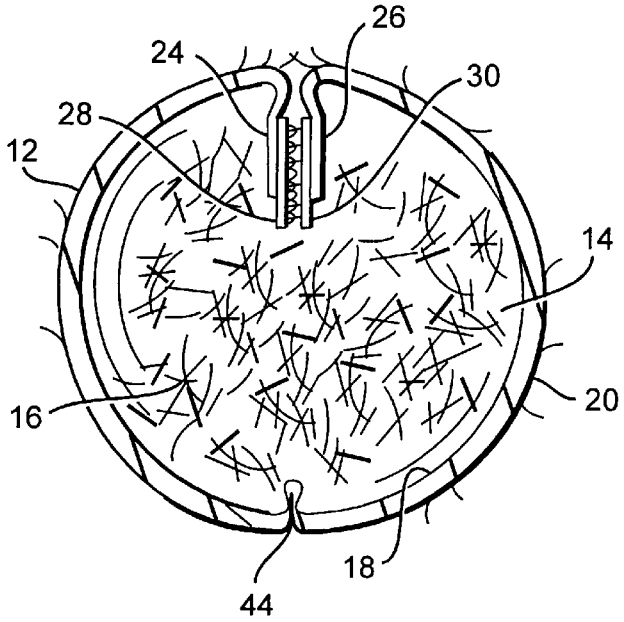
FIG. 3 is a cross sectional view of the fabric toy shown in FIG. 1, as viewed from line 3—3.

Referring to FIGS. 1–3, a fabric toy 10 in accordance with the preferred embodiment of the present invention is illustrated in several views. Generally, fabric toy 10 is configured to hold a quantity of stuffing material such that the stuffing material can be inserted and removed as necessary. In the preferred embodiment described herein, the stuffing material is catnip. Although fabric toy 10 is suitable for use as a catnip-filled cat toy, nothing prevents the present invention from being utilized as a stuffed ball, a cosmetic dispensing bag, a deodorizing bag, or any other apparatus that holds a quantity of stuffing material. In addition, the precise shape and size of fabric toy 10 can be altered according to the specific application.

Fabric toy 10 includes a pliable shell 12, which is preferably formed from a washable material. Although fabric toy 10 is depicted as a banana-shaped toy, shell 12 may be shaped, colored, and sized to suit individual applications. Shell 12 is hollow and it includes an interior cavity 14 formed within it. Shell 12 is configured to hold a stuffing material 16 (e.g., catnip) within interior cavity 14. To enable fabric toy 10 to release the catnip essence, shell 12 is preferably formed from a relatively porous and gas permeable material. As shown in FIG. 3, interior cavity 14 is substantially defined by an inner surface 18 of shell 12. An outer surface 20 of shell 12 may be textured and have an associated nap direction (not shown).

Shell 12 includes an opening 22 formed therein. Opening 22 is configured to provide access to interior cavity 14. Stuffing material 16 is inserted and removed through opening 22. Surrounding opening 22 are a first flap 24 and a second flap 26. Flaps 24 and 26 may, but need not be, integrally formed in shell 12. As shown in FIG. 2, flaps 24 and 26 are each adjacent to opening 22 and are located on opposite sides of opening 22. Nothing requires flaps 24 and 26 to be configured as shown. For example, flaps 24 and 26 may be "blended" into shell 12 without having noticeable edges or corners.

A first sealing element 28 is coupled to first flap 24 and a second sealing element 30 is coupled to second flap 26 (see FIG. 3). Sealing elements 28 and 30 are coupled to outer surface 20 of shell 12 and are configured to releasably seal opening 22. Opening 22 is effectively sealed when sealing elements 28 and 30 engage one another. According to the preferred embodiment, sealing elements 28 and 30 are cooperating strips of a conventional hook and loop fastener. Of course, fabric toy 10 may employ other suitable sealing components, such as snaps or adhesive strips.

Flaps 24 and 26 and sealing elements 28 and 30 are preferably configured such that flaps 24 and 26 extend into interior cavity 14 when opening 22 is sealed. This preferred sealing arrangement is shown in FIG. 3. As described above, first and second sealing elements 28 and 30 are coupled to outer surface 20 of first and second flaps 24 and 26, respectively. Thus, flaps 24 and 26 are folded inward within interior cavity 14 and sealing elements 28 and 30 are engaged to seal opening 22. Consequently, flaps 24 and 26 and sealing elements 28 and 30 are located substantially within interior cavity 14 when opening 22 is sealed. When sealed properly, flaps 24 and 26 and sealing elements 28 and 30 are hidden from view, which enhances the appearance of fabric toy 10 and reduces the likelihood that fabric toy 10 will be accidentally opened.

To promote efficient sealing of opening 22, the lengths of opening 22, flaps 24 and 26, and sealing elements 28 and 30 are approximately equal. This configuration reduces leakage of stuffing material 16 from the ends of opening 22.

Figure 4:
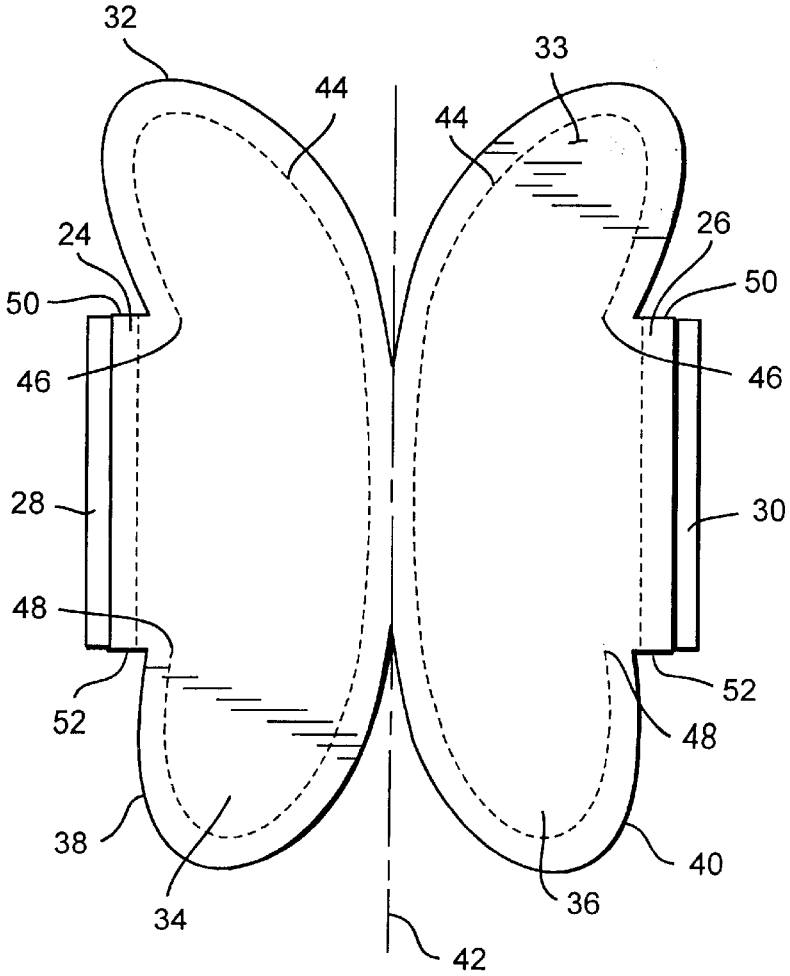
FIG. 4 is a top view of a pattern used to construct the fabric toy.

Referring to FIG. 4, a top view of a pattern of material 32 is illustrated. An inner side 33 of pattern 32 is shown face-up in FIG. 4 and a corresponding outer side is hidden from view. Shell 12 is preferably formed from pattern 32, which includes a first portion 34 and a substantially symmetrical second portion 36. First portion 34 has a first perimeter 38 and second portion 36 has a second perimeter 40. Pattern 32 is cut to form first and second flaps 24 and 26, which are located on first and second portions 34 and 36, respectively. In the preferred embodiment, flaps 24 and 26 extend approximately ¼ inch beyond the sections of pattern 32 that form the body of fabric toy 10.

In accordance with a preferred method of construction, sealing elements 28 and 30 are coupled to pattern 32 before shell 12 is formed. For example, first and second sealing elements 28 and 30 may be sewn onto first and second flaps 24 and 26, respectively. Sealing elements 28 and 30 are coupled to the outer surface of pattern 32 such that their sealing surfaces (e.g., the hook and loop surfaces) are relatively continuous with the outer surface of pattern 32. As such, the sealing surfaces are hidden from view in FIG. 4. To ensure that opening 22 seals in a desirable manner, first and second sealing elements 28 and 30 preferably extend beyond the respective longitudinal edges of flaps 24 and 26, as shown in FIG. 3.

After first and second sealing elements 28 and 30 are attached to first and second flaps 24 and 26, respectively, pattern 32 is folded along a line 42 such that the outer sides of first and second portions 34 and 36 face one another. It should be appreciated that nothing requires pattern 32 to be formed from a single piece of material, e.g., shell 12 may be formed from two separate portions. First and second perimeters 38 and 40 are substantially aligned after pattern 32 is folded along line 42. Sealing elements 28 and 30 may be engaged to maintain the alignment of flaps 24 and 26 during the formation of a seam 44 that couples first and second portions 34 and 36 together.

Seam 44 is depicted as a dashed line in FIG. 4. Seam 44 is formed with the outer sides of portions 34 and 36 facing one another. In the preferred embodiment, seam 44 is formed by stitching around the perimeter of pattern 32. Of course, labels, decorative elements (such as a banana stem 45), and/or other accessories may be added to shell 12 while seam 44 is formed. Seam 44 is partially formed around the perimeter, i.e., seam 44 is discontinuous at opening 22 (see FIG. 2). In the preferred embodiment, the distance that seam 44 is offset from the edge of pattern 32 is approximately the same as the distance that flaps 24 and 26 extend beyond the edge of pattern 32. In other words, approximately ¼ inch of material remains between seam 44 and the edge of pattern 32.

Seam 44 has a first end 46 and a second end 48 that cooperate to define opening 22. In accordance with the preferred embodiment, first and second flaps 24 and 26 each have a first edge 50 and a second edge 52 that are substantially aligned with first and second seam ends 46 and 48, respectively. In other words, an imaginary line extended from first flap edge 50 approximately intersects a point defined by first seam end 46. Similarly, an imaginary line extended from second flap edge 52 approximately intersects a point defined by second seam end 48.

In an alternate embodiment (not shown) where flaps 24 and 26 are "blended" into pattern 32, flaps 24 and 26 do not have noticeable edges equivalent to first and second edges 50 and 52 described above. In such an embodiment, first and second sealing elements 28 and 30 may have edges that are substantially aligned with first and second seam ends.

First and second seam ends 46 and 48 are formed with an increased displacement from the perimeter of shell 12 at opening 22. In other words, the distance between the perimeter and seam 44 is greater at seam ends 46 and 48 than at the remaining portions of shell 12.

The preferred relationship between seam ends 46 and 48 and flap edges 50 and 52 enables opening 22 to be effectively sealed after fabric toy 10 is filled with stuffing material 16. In addition, the construction of seam 44 reduces puckering and kinking of shell 12 during assembly, packaging, and while fabric toy 10 is displayed.

After seam 44 is formed, shell 12 is in an inside-out state. Subsequently, shell 12 may be manipulated such that the inner sides of first and second portions 34 and 36 face one another. In other words, shell 12 is placed right-side-out (as shown in FIG. 2. If desired, shell 12 may be subsequently filled with stuffing material 16.

To seal opening 22, first and second flaps 24 and 26 are preferably folded inward such that they extend within interior cavity 14 (see FIG. 3). In FIG. 2, first flap 24 is in an unfolded position with first sealing element 28 facing outward, and second flap 26 is in a folded position with second sealing element 30 extending into interior cavity 14. In the folded positions, flaps 24 and 26 may be sealed together by engaging first and second sealing elements 28 and 30. As shown in FIG. 1, sealing elements 28 and 30 are preferably hidden from view when opening 22 is sealed. Because sealing elements 28 and 30 may be separated and resealed, stuffing material 16 can be easily removed to facilitate washing of shell 12. In addition, an aromatic stuffing material 16, such as catnip, can be replenished after it has become stale.

In summary, the present invention provides an improved fabric toy for holding a quantity of stuffing material. The fabric toy has a sealable opening that facilitates the insertion and removal of filler material. The fabric toy utilizes sealing elements that are unexposed when the fabric toy is sealed. In addition, the fabric toy is relatively easy to assemble and it experiences little puckering and kinking during assembly.

The above description is of a preferred embodiment of the present invention, and the invention is not limited to the specific embodiment described and illustrated. Furthermore, many variations and modifications will be evident to those skilled in this art, and such variations and modifications are intended to be included within the spirit and scope of the invention, as expressed in the following claims.

What is claimed is:

1. A stuffed toy enabling a user to remove used stuffing material and refill as needed, said toy comprising:

a pliable shell having a perimeter, said pliable shell formed by a plurality of fabric elements having a periphery, and said perimeter forming an interior cavity thereby;

a seam partially formed around said periphery of said elements and displaced from said periphery, said seam having first and second ends configured to define an opening formed within said shell, said opening providing access to said interior cavity; and means for releasably sealing said opening, said means for sealing being coupled to said shell proximate said opening, and said means for sealing being configured to open for removal of said stuffing material and close for use; wherein said first and second seam ends are proximate a standard distance from said periphery on said perimeter, and have an increased displacement from said periphery adjacent said opening.

2. The apparatus of claim 1, wherein said means for sealing is coupled to a plurality of flaps surrounding said opening and joined to said shell, and wherein said means for sealing are configured such that said flaps extend into said interior cavity when said opening is sealed, said interior cavity being configured to hold said stuffing material.

3. The apparatus of claim 2, wherein:

said shell has an outer surface;

said means for sealing comprises a hook fastener coupled to said outer surface and a loop fastener coupled to said outer surface; and said hook fastener and said loop fastener are configured to engage one another.

4. The apparatus of claim 2, wherein said flaps and said means for sealing are configured to be located substantially within said interior cavity when said opening is sealed.

5. The apparatus of claim 2, wherein:

said first and second flaps oppose one another relative to said opening;

said means for sealing comprises a first sealing element coupled to a first one of said flaps and a second sealing element coupled to a second one of said flaps; and said first and second sealing elements are configured to engage one another.

6. The apparatus of claim 2, wherein said flaps are integrally formed in said shell.

7. The apparatus of claim 6, wherein said shell has an outer surface and said means for sealing is coupled to said outer surface.

8. A stuffed toy enabling a user to remove used stuffing material and refill as needed, said toy comprising:

a pliable shell having a perimeter and an interior cavity formed thereby;

a seam partially formed on said perimeter of said shell, said seam having first and second ends configured to define an opening formed within said shell, said opening providing access to said interior cavity; and sealing means, coupled to said shell proximate said opening, for releasably sealing said opening, said sealing means being configured to release, for removal of said stuffing material, and seal for use, and said sealing means being longer than said opening thereby being constricted by said opening established by placement of said seam ends on said perimeter to protect against unwanted manipulation and release when inserted through said opening.

* * * * *